US007114697B2

(12) United States Patent
Millet et al.

(10) Patent No.: US 7,114,697 B2
(45) Date of Patent: Oct. 3, 2006

(54) FAST VALVE ACTUATOR AND TOOL PROVIDED WITH SAME

(75) Inventors: François Millet, Antony (FR); Christophe Michaud, Soignolles En Brie (FR); François Girardi, Cormeilles-En-Parisis (FR)

(73) Assignee: GeoServices, Le Blanc-Mesnil (FR)

( * ) Notice: Subject to any disclaimer, the term of this patent is extended or adjusted under 35 U.S.C. 154(b) by 75 days.

(21) Appl. No.: 10/483,240

(22) PCT Filed: Jul. 4, 2003

(86) PCT No.: PCT/FR03/02083

§ 371 (c)(1),
(2), (4) Date: Jan. 19, 2005

(87) PCT Pub. No.: WO2004/011769

PCT Pub. Date: Feb. 5, 2004

(65) Prior Publication Data

US 2005/0115714 A1 Jun. 2, 2005

(30) Foreign Application Priority Data

Jul. 24, 2002 (FR) ..... 02 09400

(51) Int. Cl.
*F16K 31/44* (2006.01)

(52) U.S. Cl. ..... 251/75; 251/79; 166/332.1

(58) Field of Classification Search ..... 251/75, 251/79; 166/316, 332.1
See application file for complete search history.

(56) References Cited

U.S. PATENT DOCUMENTS

| | | | | |
|---|---|---|---|---|
| 3,889,751 | A * | 6/1975 | Peters | 166/319 |
| 4,129,184 | A | 12/1978 | Parker | |
| 5,234,057 | A | 8/1993 | Schultz et al. | |
| 5,279,363 | A | 1/1994 | Schultz et al. | |
| 5,332,035 | A | 7/1994 | Schultz et al. | |
| 5,375,658 | A | 12/1994 | Schultz et al. | |

* cited by examiner

*Primary Examiner*—Edward K. Look
*Assistant Examiner*—John K. Fristoe, Jr.
(74) *Attorney, Agent, or Firm*—Wenderoth, Lind & Ponack, L.L.P.

(57) ABSTRACT

The invention relates to a quick-acting valve actuator comprising:

a driven member (31) driven by a drive device (35) suitable for causing the driven member (31) to travel along a stroke (C1) to a trigger position; and locking-and-trigger means (41) co-operating with the driven member (31) and the actuator member (21) so that:

during the stroke (C1), the actuator member (21) is stationary, and the driven member (31) is moving; and when the driven member (31) reaches the trigger position, the driven member (31) is held stationary, and the actuator member (21) is urged by prestress means (51) to open or close the valve.

36 Claims, 13 Drawing Sheets

FAST VALVE ACTUATOR AND TOOL PROVIDED WITH SAME

BACKGROUND OF THE INVENTION

The invention relates to a quick-acting valve actuator, and also to a tool fitted with the actuator.

The field of application of the invention lies with valves for placing in a duct for sub-surface working, such as, for example, in wells for producing oil or gas, and any gushing well for extracting hydrocarbons present in the sub-surface, or any injection well.

As a general rule, production wells comprise an underground wall that is pierced for passing the fluid produced by the surrounding production bed into the inside of the well, so as subsequently to rise to the surface under drive from the pressure of the fluid that exists in said bed.

Thus, for the operator of the well, it is of great importance for a large quantity of production fluid to be taken from the well per unit time, i.e. for the production yield to be as high as possible. This production yield can be influenced by various parameters and conditions. One of these parameters, relating solely to the structure of the borehole, is the flow cross-section for the production fluid between the underground bed and the wall of the well. The greater this flow section, the greater the quantity of fluid that can be taken from the well. This flow section can become polluted by materials and fluids such as drilling mud, casing cement, or solid materials conveyed by the production fluid.

Nevertheless, it is difficult to know whether or not too small a production rate of fluid raised to the surface is due to the magnitude of the flow section between the underground layer and the well.

In order to evaluate the value of the flow section, it is known to monitor the pressure and the temperature that exist in the underground production layer. By closing and/or opening the valve situated between the surface and the production bed, through which valve the production fluid needs to pass in order to be raised to the surface, it is possible, starting from the measured temperature and pressure, to obtain information about the flow section at the underground layer, also known as its "skin", and about its permeability.

By closing the valve suddenly, the pressure measured at the production bed is caused to pass from a production pressure P1 to a deposit pressure P2 that is higher, as shown in FIG. 1. Conversely, starting with a closed valve, when it is caused to open suddenly, the pressure measured at the production bed is caused to pass from the deposit pressure P2 to the production pressure P1.

The pressure measurement curves need to be used both in terms of value and also in terms of slope a as a function of time t. Thus, the time T taken by the measured pressure P to go from the production pressure P1 to the deposit pressure P2 is itself equal to a value lying in the range half a day to ten days.

In the event of opening and/or closing taking place quickly, the pressure curve approximates, at least during the initial stage immediately following full opening or closure, to a general first-order curve in response to a step in the flow rate and the valve, characteristic of the valve switching instantaneously between its closed state and its open state, or vice versa. Thus, a steep slope ax as presented by the curve of FIG. 1 indicates a skin that is thin or a flow section that is little obstructed, thereby leading to greater production yield.

It is then easy to deduce information therefrom relating to the fluid flow section at the production bed.

In contrast, if the opening and the closure of the valve are too slow, i.e. if the length of time that elapses between the valve being fully open and/or being fully closed is too great, then the pressure response approximates to a curve of order greater than one, such as the curve shown in FIG. 2, in which the slope of pressure as a function of time begins by increasing up to a point of inflection I, after which it decreases until the pressure settles down to steady conditions.

Under such circumstances, it is much more difficult to make any use of the curve of measured pressure P since it depends on various parameters in addition to the flow section at the production bed. Thus, the curve of measured pressure P is unusable for the time TI that elapses until the point of inflection I.

The invention seeks to obtain a valve actuator and a tool provided with the actuator that enables the valve to be opened and/or closed as quickly as possible between the last instant in which the valve is fully open and/or fully closed, and the instant in which the valve becomes fully closed and/or open, so that the flow rate measured downstream from the valve approximates as closely as possible to a step in the flow rate as a function of time, so that the response to valve actuation is as close as possible to the curve shown in FIG. 1.

SUMMARY OF THE INVENTON

To this end, in a first aspect, the invention provides a quick-acting valve actuator comprising:

- an actuator body; and
- a valve actuator member movable in the actuator body between a valve closed position and a valve open position;
- the actuator being characterized in that it further comprises:
- a drive device in the actuator body;
- a driven member driven by the drive device relative to the actuator body, the drive device being suitable for causing the driven member to pass via a first stroke to a first trigger position;
- prestress means for prestressing the actuator member relative to the driven member in order to exert a repulsion force thereagainst when the driven member passes along its first stroke to its first trigger position, said force tending to cause the actuator member at least to pass from a first determined position selected from the valve-open and valve-closed positions to the second determined position selected from the valve-open and valve-closed positions; and
- locking-and-trigger means stationary relative to the actuator body and co-operating with the driven member and the actuator member so that:
  - during the first stroke, the actuator member is stationary in the first determined position relative to the locking-and-trigger means and the driven member moves relative to the locking-and-trigger means; and
  - when the driven member reaches the first trigger position, the driven member is stationary relative to the locking-and-trigger means and the actuator member is urged by the prestress means relative to the locking-and-trigger means so that the actuator member passes from the first determined position to the second determined position.

By means of the invention, energy is accumulated in the actuator so as to make it possible to cause the valve to pass quickly from the open or closed state to the closed or open state so as to cause a steep slope to appear in the flow rate close to a step at the valve. It is then easier to make use of the pressure response at the flow section in order to determine the state of the flow section.

Thus, even if the power available for powering the drive device is low or limited, the invention allows the valve to move quickly between the open or closed position and the closed or open position. Where appropriate, the actuator can drive a plurality of valve opening and closing movements. It is thus possible to raise the valve and the tool containing it in the open state after an opening movement or after a closing movement followed by an opening movement, which is not possible with valves that can perform a single closing movement only. In addition, the actuator makes it possible to perform opening and/or closing quickly in succession in a plurality of successive production beds of the well.

Furthermore, closing and/or opening the valve quickly serves to avoid it becoming prematurely damaged under conditions of use. The production fluid carries abrasive materials such as sand, and it passes through the valve at a speed that is very high. This high speed is due to the large pressure difference between the upstream and downstream sides of the valve, which difference increases when the fluid flow gap through the valve is small at the end of closure, or at the beginning of opening. Consequently, the production fluid tends to press against the slide or the moving piston of the valve during its closing or opening movement. Because of the speed of the closing and/or opening movement of the valve, its moving part is exposed to the production fluid at high speed for a shorter length of time, thereby reducing wear and lengthening lifetime, and avoiding the need to raise the valve for replacement purposes, which is expensive in terms of equipment and lengthens the time during which the production well is under testing.

Accumulating energy in the actuator of the invention also makes it possible to guarantee that the force exerted on the valve overcomes the resistance between its moving part and its stationary part, as might be due to adhesion of the sealing means between them, resulting from the high temperature and pressure conditions that exist in the well. Consequently, the actuator and the tool including the actuator can be more reliable.

According to other characteristics of the invention:

the drive device is suitable for causing the driven member to pass along a second stroke to a second trigger position, the prestress means being suitable, when the driven member passes along the second stroke to its second trigger position, for exerting a repulsion force thereagainst tending to cause the actuator member to pass from the second determined position to the first determined position, and the locking-and-trigger means is configured to co-operate with the driven member and the actuator member so that:

during the second stroke, the actuator member is stationary in the second determined position relative to the locking-and-trigger means, and the driven member moves relative to the locking-and-trigger means; and when the driven member is in the second trigger position, the driven member is stationary relative to the locking-and-trigger means, and the actuator member is urged by the prestress means relative to the locking-and-trigger means so that the actuator member passes from the second determined position to the first determined position;

the stroke is longitudinal, the actuator member being movable longitudinally between the valve-closed position and the valve-open position, the driven member being longitudinally movable relative to the actuator body over the stroke;

the locking-and-trigger means comprise:

at least one wedging part movable transversely relative to the actuator body; and first and second recesses for housing the wedging part respectively in the driven member and in the actuator member, the first and second recesses being offset at least longitudinally during the first stroke up to the first trigger position, so that the wedging part lies outside the first recess of the driven member and in the second recess of the actuator member so as to secure the actuator member longitudinally relative to the support and allow the driven member to move longitudinally relative to the support, and the first and second recesses come transversely face to face in the first trigger position so that the wedging part can pass out from the second recess of the actuator member into the first recess of the driven member so as to secure the driven member longitudinally relative to the support and allow the actuator member to move longitudinally relative to the support;

the locking-and-trigger means include third and fourth recesses for housing the wedging part respectively in the driven member and in the actuator member, the third recess being longitudinally spaced apart from the first recess, the third and fourth recesses being offset at least longitudinally during the second stroke up to the second trigger position so that the wedging part lies outside the third recess of the driven member and in the fourth recess of the actuator member so as to cause the actuator member to be secured longitudinally relative to the support and allow the driven member to move longitudinally relative to the support, the third and fourth recesses coming transversely face to face in the second trigger position so that the wedging part can pass out from the fourth recess of the actuator member into the third recess of the driven member so as to cause the driven member to be secured longitudinally relative to the support and allow the actuator member to move longitudinally relative to the support;

the wedging part is mounted to move freely transversely in a support that is stationary relative to the actuator body and that is provided transversely between the driven member and the actuator member;

the wedging part is constituted by a ball; or the wedging part is constituted by a roller;

the driven member includes a stationary guide part for guiding the wedging part during said stroke;

the wedging part is formed by a jaw of a transversely flexible tab and connected, at a longitudinal distance from the jaw, to a part that is stationary relative to the body; or the driven member includes a stationary support part having a guide sleeve mounted to move longitudinally thereon to guide the wedging part during said stroke, the guide sleeve being suitable for being urged longitudinally by the wedging part when the wedging part penetrates into the recess of the driven member;

at least one of the recesses provided in the actuator member is outwardly open to enable the wedging part to be inserted into the support; or the first position corresponds to the valve-open position and the second position corresponds to the valve-closed position; or the first position corresponds to the valve-closed position and the second position corresponds to the valve-open position;

the prestress means is such as to increase the repulsion force between the actuator member and the driven member while the driven member is passing along its stroke to its trigger position, and such that it exerts a force for preventing the actuator member from moving when in its second determined position;

the actuator member comprises a rod secured to a jacket, the driven member comprises a rod that is longitudinally movable inside the jacket and that has at least a first pusher for pushing the prestress means longitudinally while the driven member is traveling along its stroke to the trigger position, a second pusher being provided between the prestress means and the jacket;

the jacket has first and second abutments for first and second spacers movably mounted between the prestress means and the first and second pushers respectively, the jacket including first and second additional penetration spaces respectively for the first and second pushers while the driven valve is moving along its stroke to the associated longitudinal trigger position;

the prestress means is formed by a compression spring between the actuator member and the driven member;

the compression spring is helical and wound around the rod of the driven member;

the compression spring has turns undulating around the rod of the driven member;

the driven member comprises a nut prevented from turning inside the actuator body and co-operating with a threaded shank driven in rotation by the drive device to move the driven member longitudinally;

the actuator includes sealing means between the actuator body and the actuator member for sealing the drive device, the driven member, the prestress means, and the locking-and-trigger means relative to the outside;

the sealing means comprise a piston mounted to slide longitudinally along the actuator member, the piston of the sealing means including sealing gaskets applied respectively against the inside of the actuator housing and against the actuator member;

the space inside the actuator body situated behind the sealing means and containing the drive device, the driven member, the prestress means, and the locking-and-trigger means, is filled with an operating fluid;

the operating fluid is constituted by a lubricating oil;

the actuator body also contains means for powering the drive device;

the actuator body further contains a sealed feedthrough for electrically connecting the drive device to power supply and control means therefor on board the actuator;

the drive device is a motor-and-gearbox unit;

the drive device includes a brushless motor; and the drive device includes a roller screw for driving a nut of the driven member.

In a second aspect, the invention provides a tool comprising a valve having an open position and a closed position, and an actuator for the valve.

According to other characteristics of the invention:

the tool further comprises at least one measurement sensor and means for recording measurement information from the sensor, the actuator being located longitudinally between the valve and said sensor;

the valve comprises a piston which is mounted to move between a position for closing and a position for opening at least one hole in a valve body opening to the outside relative to a fluid-passing space, and connected to a fastener member for fastening to a corresponding member of the actuator member;

the fastener member is formed by a thread co-operating with a complementary thread forming the corresponding member of the actuator member;

the corresponding member of the actuator member is formed by a clamp comprising a plurality of resilient branches suitable for occupying a splayed open position enabling a hooking part forming a fastener member to be inserted therebetween while they lie outside a guide wall provided in the valve, and which are suitable for clamping on the hooking part while they are to be found against the guide wall between the closed position and the open position;

the piston of the valve is connected to the fastener member with determined longitudinal clearance that is shorter than the distance that exists between the open position and the closed position thereof; and the valve further comprises a secondary piston which is slidably mounted in a chamber of the piston having secondary fluid communication means between the hole and the fluid-passing space, which is connected to the actuator member, which closes the chamber of the piston in the closed position, and which is suitable during passage of the actuator member from the closed position to the open position for causing the hole to communicate with the fluid-passing space via the secondary communication means.

BRIEF DESCRIPTION OF THE DRAWINGS

The invention will be better understood on reading the following description given purely by way of non-limiting example and with reference to the accompanying drawings, in which.

DETAILED DESCRIPTION OF THE INVENTION

Figure 1:
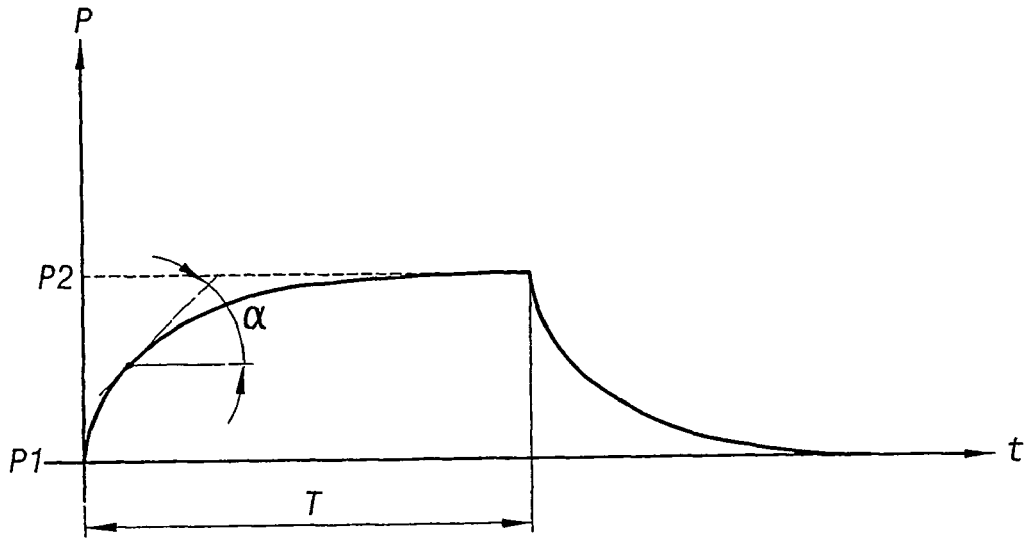
FIG. 1, described above, is a graph plotting a curve of pressure measured in the underground fluid production bed of a well and enabling information to be obtained concerning the flow section.
Figure 2:
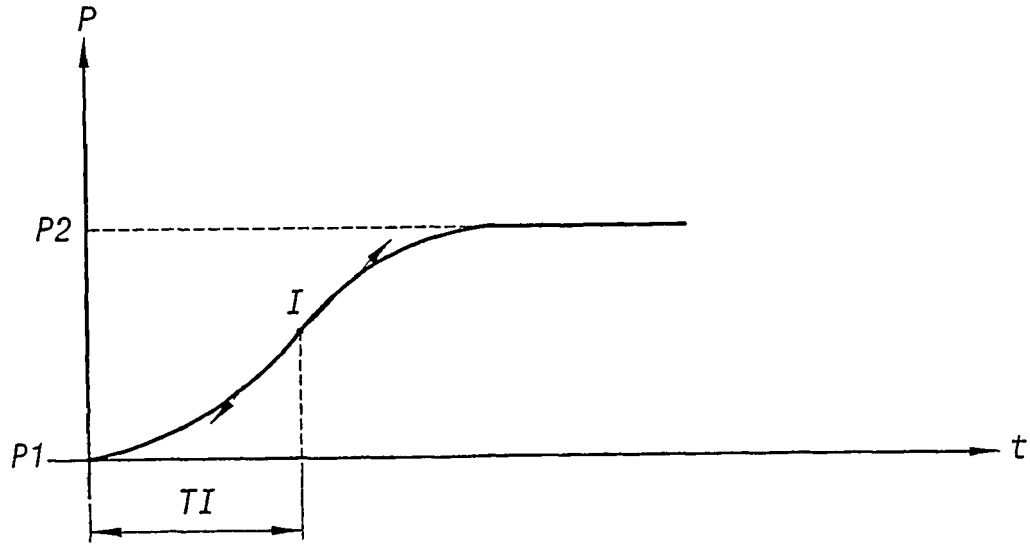
FIG. 2, described above, is a graph plotting another curve of pressure measured in the underground fluid production bed of a well.

The actuator 1 of the invention shown in FIGS. 4 to 10 comprises an actuator outer body 2 extending along a general longitudinal direction 3 directed from back to front, e.g. in the direction in which the production fluid rises towards the top of the well. The actuator body 2 includes means 4 for connection to a body 5 of a valve 6, e.g. complementary threads on the bodies 2 and 5, such as an inside thread 4*a* on the inside top end of the actuator body 2 and a complementary thread 4*b* on the bottom outside end of the valve body 5, the bodies 2 and 5 being hollow and, for example, tubular and of circular cross-section.

The valve 6 has a plurality of holes 7 or ports distributed transversely to pass the production fluid from the outside of the body 5 into a front space 14 of the valve towards the top of the well. Naturally, a single hole 7 could be provided. A piston 8 is slidably mounted in the body 5 in register with the hole 7 between the front space 14 and a rear space 15. The piston 8 has a wall 11 supporting first and second outside sealing gaskets 9 and 10 that are proof against the production fluid and that are spaced apart longitudinally from back to front. For best dynamic behavior, the valve and the tool of which it forms a part should be placed immediately above the production bed.

Figure 4:
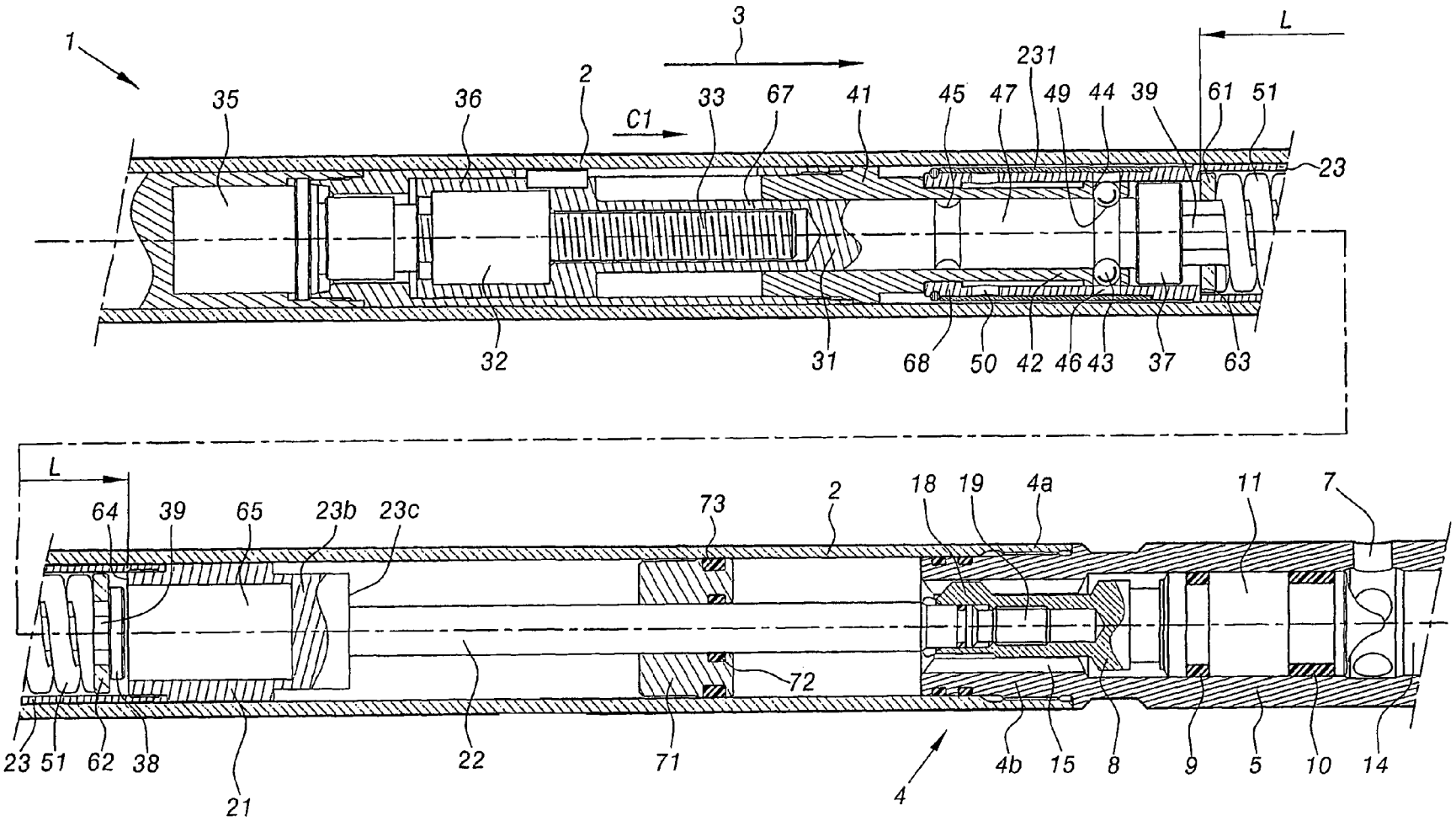
FIG. 4 is a diagrammatic longitudinal section view of a valve actuator in accordance with the invention in a position for triggering valve opening.
Figure 5:
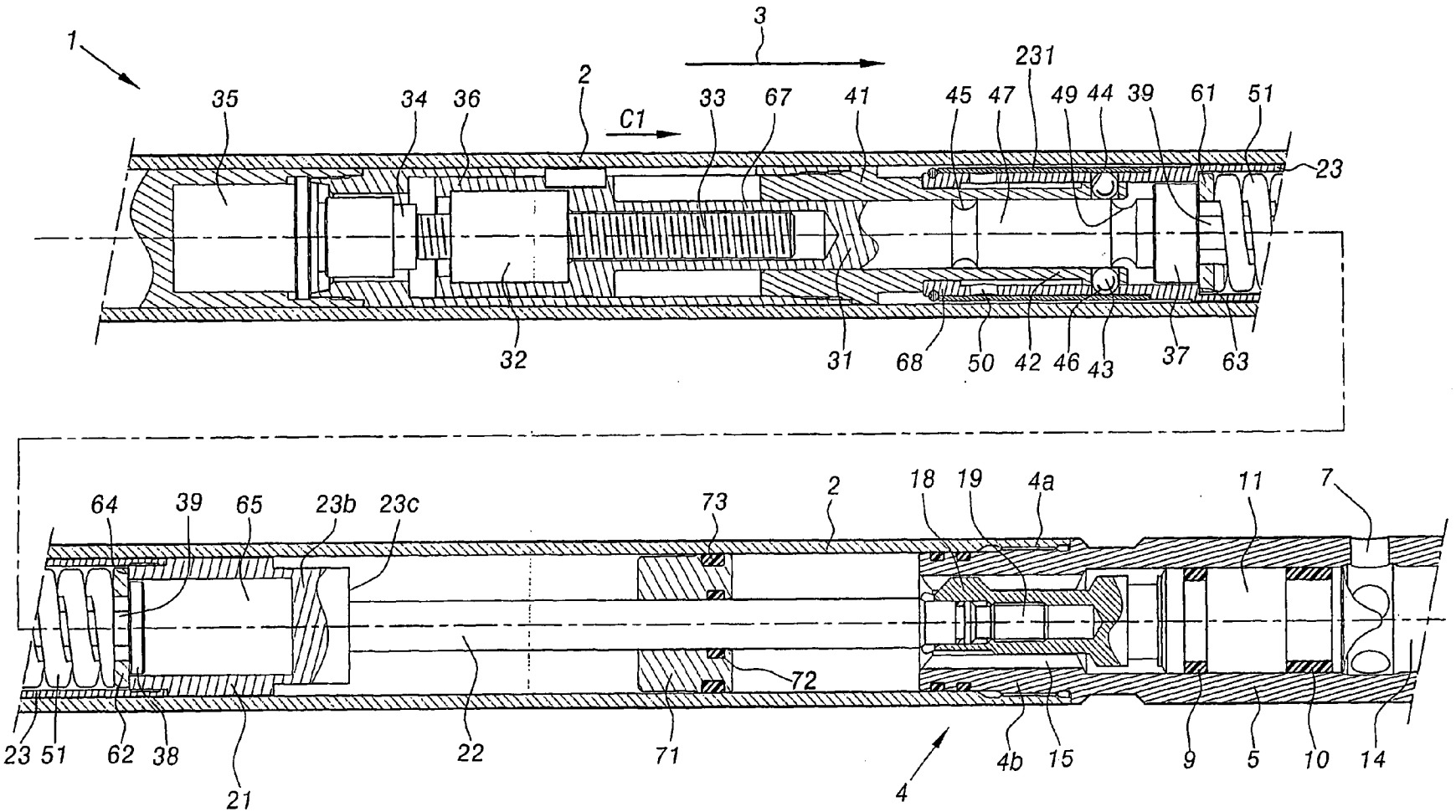
FIGS. 5 and 6 are diagrammatic longitudinal section views of the valve actuator in accordance with the invention in an open position of the valve during an actuation stroke from the FIG. 4 position towards a position for triggering closure of the valve.
Figure 6:
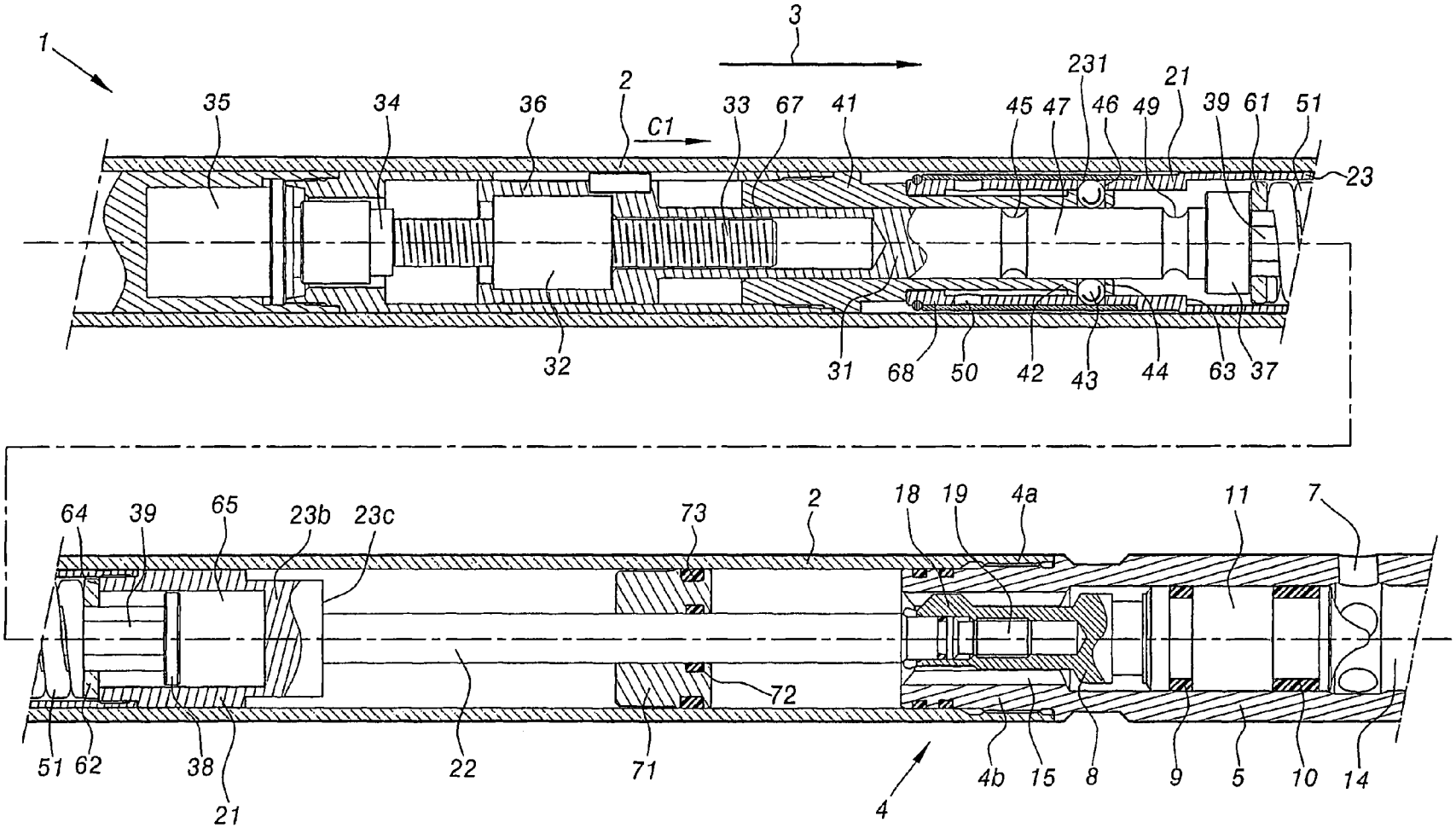

When, as shown in FIGS. 4, 5, and 6, the front gasket 10 lies behind the hole 7, the production fluid passes from the outside of the body 5 through the hole 7 and into the front space 14 in order to rise towards the surface, the valve then being in its open position.

Figure 7:
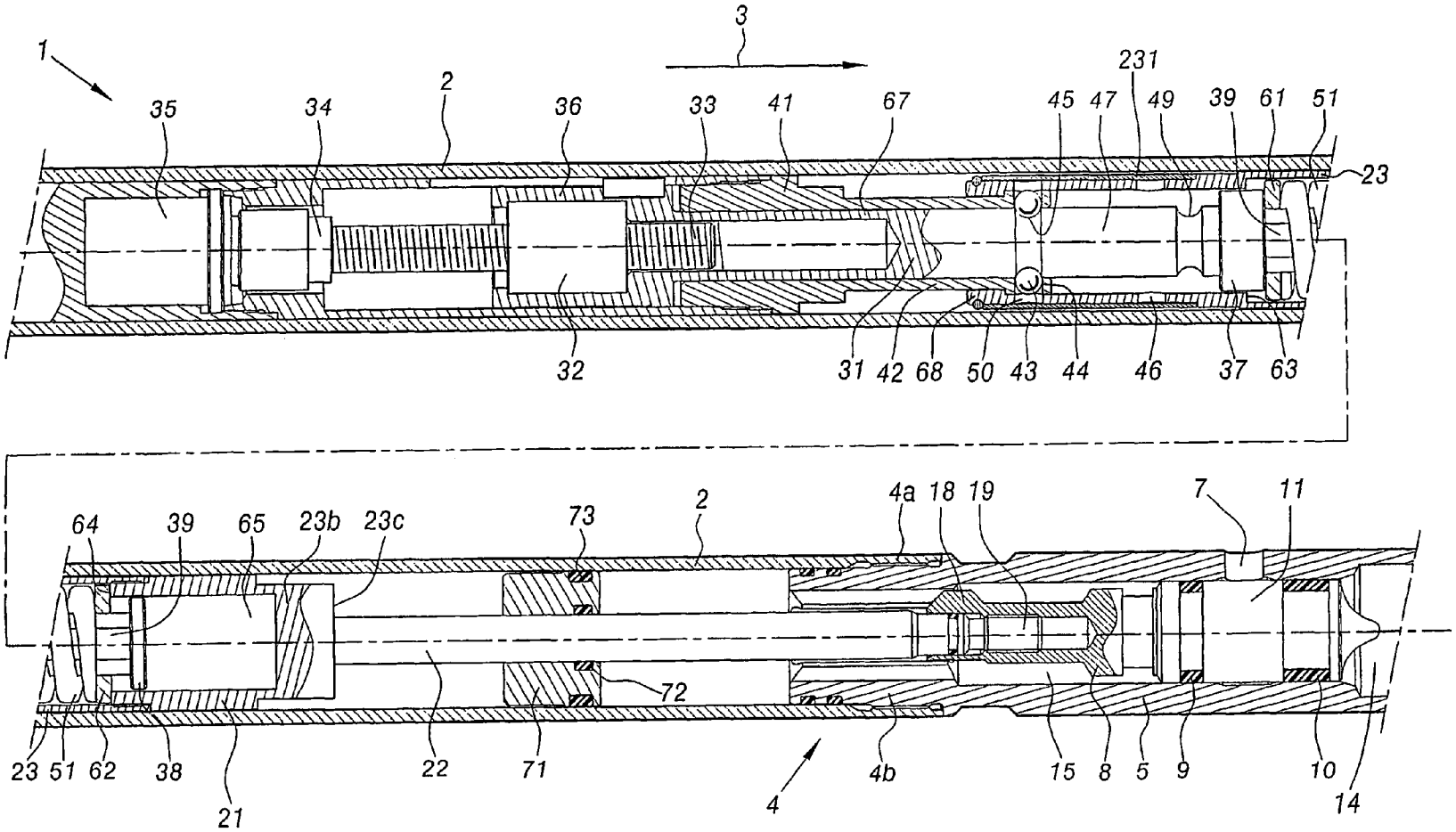
FIG. 7 is a diagrammatic longitudinal section view of the valve actuator in accordance with the invention in its position for triggering closure of the valve.
Figure 8:
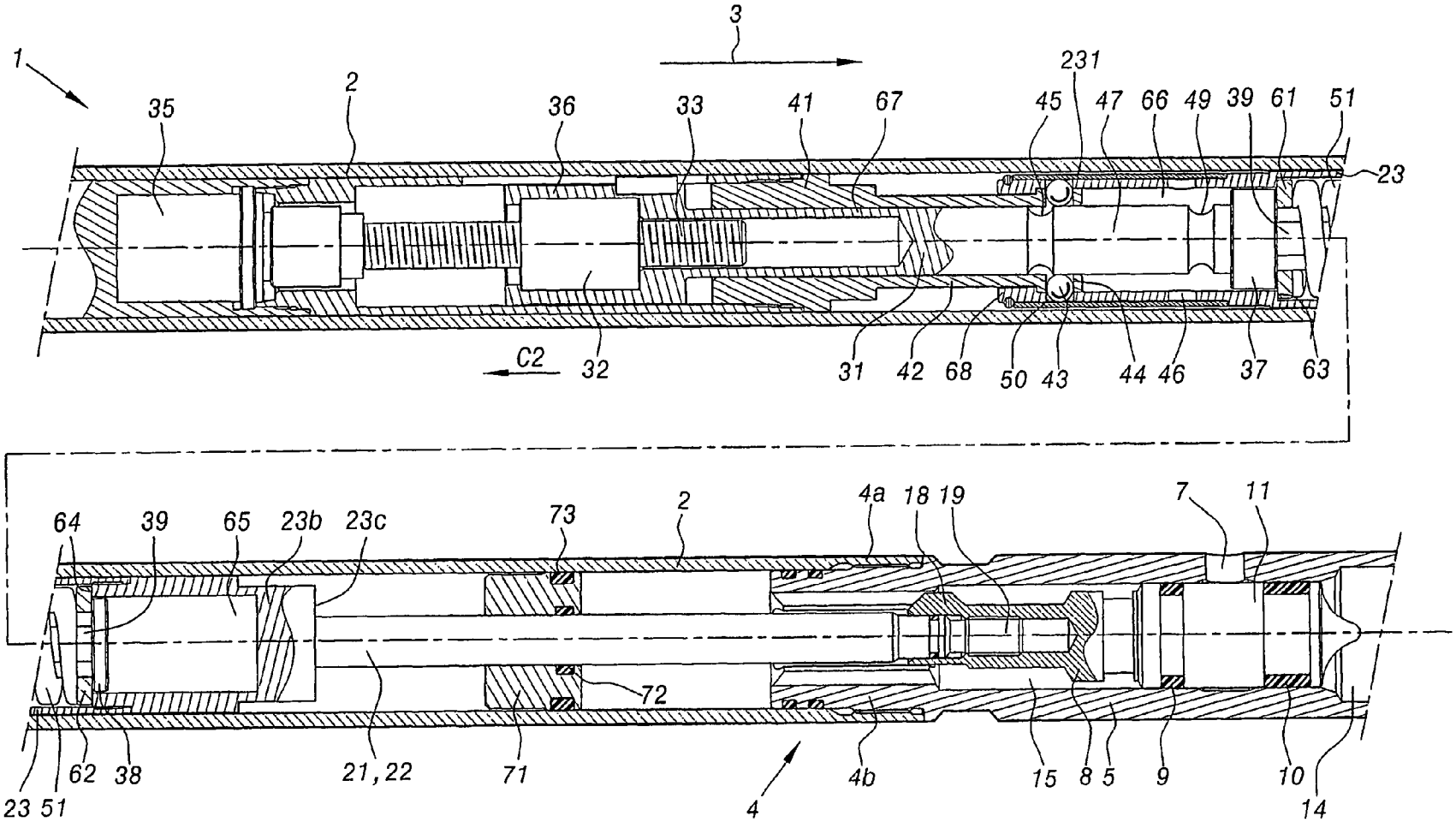
FIGS. 8 and 9 are diagrammatic longitudinal section views showing the valve actuator in accordance with the invention in a closed position of the valve during another actuation stroke from the FIG. 7 position towards the position for triggering opening of the valve.
Figure 9:
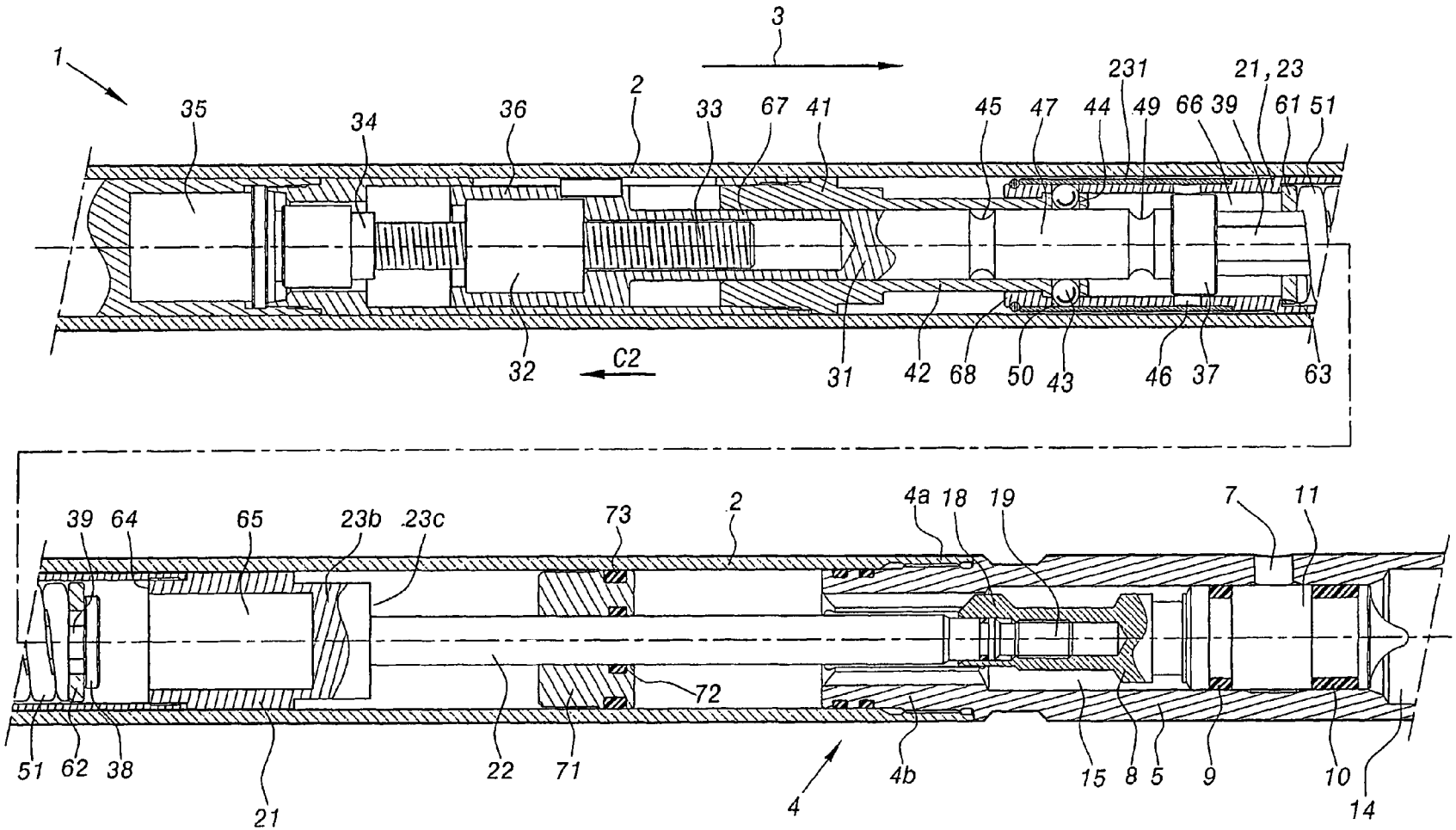

When, as shown in FIGS. 7, 8, and 9, the piston 8 is advanced into the front space 14 so that the rear gasket 9 lies behind the hole 7 and the front gasket 10 lies in front of the holes 7, the production fluid is prevented from passing into the front space 14 or from passing into the rear space 15 by the gaskets 9 and 10, so the valve is in the closed position. The production fluid is then prevented from going to the surface whenever sealing means are provided between the valve body 5 and the wall of the well.

Downstream, the valve 6 is connected to a member for locking it in place in the well, e.g. of the jaw type in which the jaws in the locking position are urged out towards the wall of the well.

There follows a description of the portions of the actuator 1 in accordance with the invention that are situated inside the actuator body 2.

The piston 8 of the valve 6 is connected to a rear fastener member 18 for fastening to a front fastener member 19 of a member 21 for actuating the valve 8 between its open and closed positions. The piston 8 is rigidly connected to the fastener member 18 shown in FIGS. 4 to 10 or in FIGS. 3A to 3C.

Figure 3A:
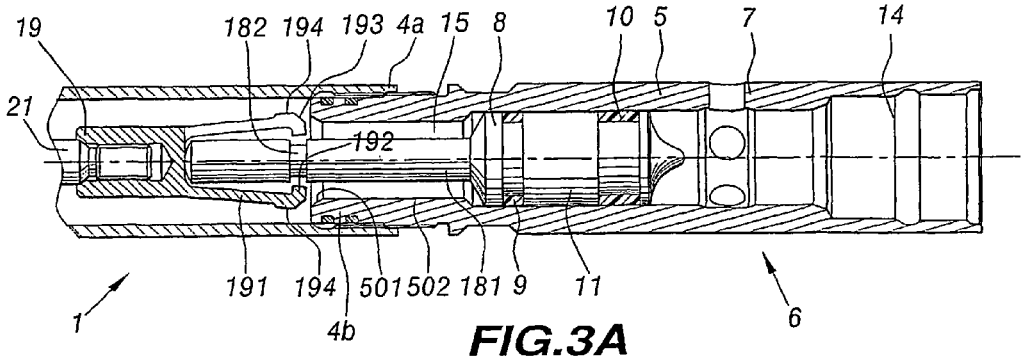
FIGS. 3A, 3B, and 3C are diagrammatic longitudinal sections showing an example of how the valve is secured to the actuator of the invention.
Figure 3B:
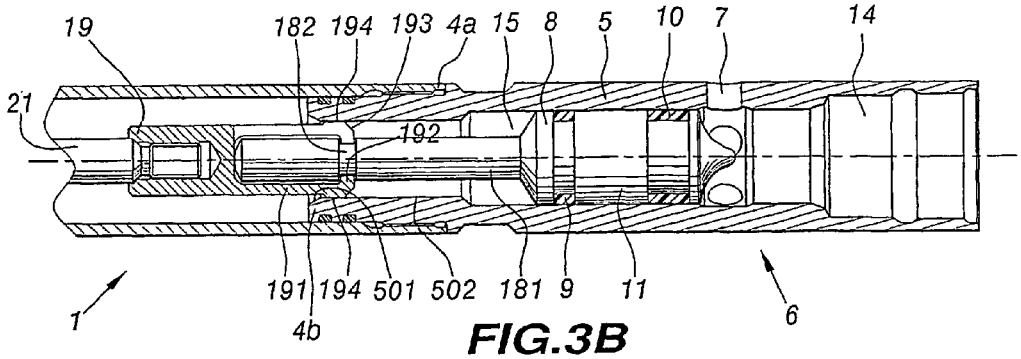
Figure 3C:
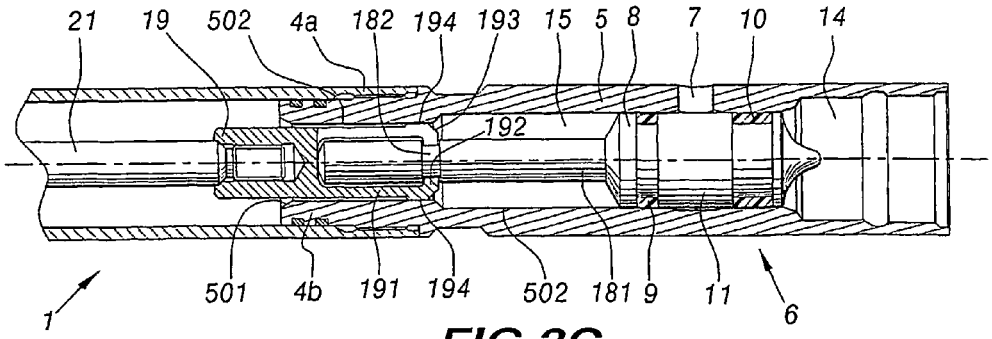

By way of example, as shown in FIGS. 3A to 3C, the front fastener member 19 of the member 21 is constituted by a clamp comprising a plurality of branches 191 provided with hooks 192 at their free ends and that are resiliently movable from an open position shown in FIG. 4A enabling a hooking part 181 constituting the member 18 to be inserted between them. The valve body 5 has a rear inner chamfer 501 co-operating with a complementary outer chamfer 193 on each of the hooks 192 in order to constrain the branches 191 to close around the hooking part 181 when it is inserted between them and the fastener member 19 of the actuator member 21 are urged longitudinally against the body 5, as shown in FIG. 3B. The hooks 192 then penetrate into a complementary groove 182 situated facing them in the hooking part 181. Each branch 191 has an outer projection 194 for keeping the hooks 192 in the closed position in the groove 182 so long as the projections 194 are in abutment against a longitudinal guide wall 502 provided inside the body 5 in front of the chamfer 501 in the open position as shown in FIG. 3B, in the closed position as shown in FIG. 3C, and in between said positions.

The fastener member 18 as shown in FIGS. 4 to 10 is constituted, for example, by an inside thread co-operating with a complementary outside thread forming the fastener member 19 of the actuator member 21.

The actuator member 21 extends longitudinally in the body 2 and comprises, for example, a rod 22 having a front end carrying the fastener member 19 for fastening to the piston 8. The actuator member 21 is movable longitudinally inside the actuator body 2 to move the piston 8 of the valve 6 between its open and closed positions.

The actuator member 21 further comprises a hollow rear longitudinal jacket 23 having a front fastening portion 23*b* for securing by any suitable means, e.g. by screw-fastening, to the rear end of the rod 22. The jacket 23 has inserted therein a driven member 31 constrained to move in longitudinal translation at the rear of the jacket 23 with a driven nut 32 that co-operates via an inside thread with a longitudinal threaded shank 33 secured to the longitudinal rotary shaft 34 of a drive device 35, e.g. constituted by a motor-and-gearbox unit, secured inside the body 2. By way of example, the threaded shank 33 is in the form of a ball screw for driving the nut 32 in longitudinal translation. By way of example, the motor in the unit 35 comprises a brushless motor. The driven member 31 may be present, for example, in the form of a longitudinal rod having a portion 36 surrounding the nut 32.

Locking-and-trigger means 41 that are longitudinally stationary relative to the body 2 are provided between the driven member 31 and the actuator member 21 and co-operate therewith.

By means of the motor unit 35, the nut 32 and the driven member 31 are suitable for occupying different longitudinal positions relative to the locking-and-trigger means 41.

Figure 10:
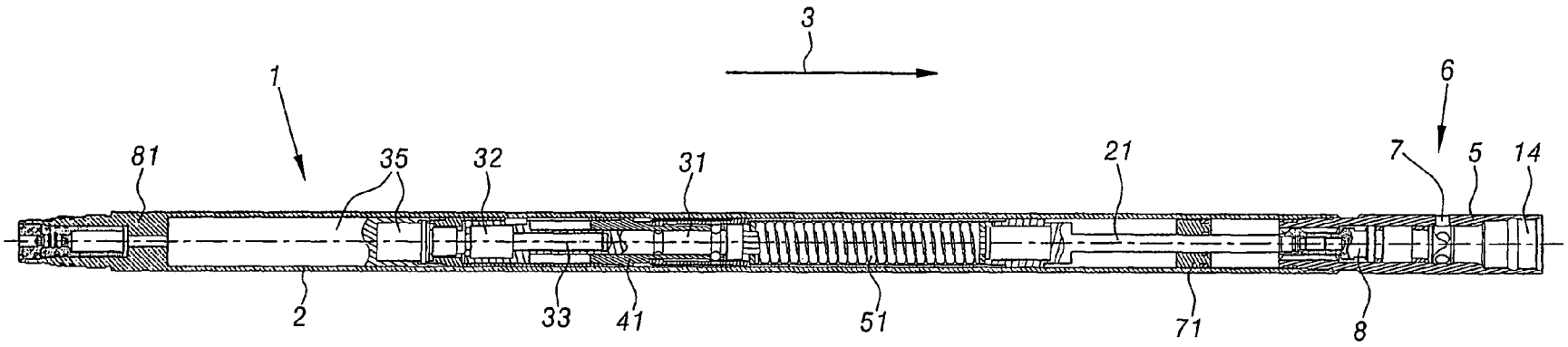
FIG. 10 is a diagram on a smaller scale than FIGS. 4 to 9 showing the actuator in accordance with the invention mounted on a valve.

Thus, the driven member 31 as shown in FIGS. 4, 5 and 6 has a first actuator stroke C1 in the body 2 going from back towards the front in the longitudinal direction of the actuator 1, or upwards in the well direction so as to take up a first longitudinal trigger position shown in FIG. 7 in which the valve is caused to pass from the open position to the closed position. Conversely, the driven member 31 as shown in FIGS. 8, 9, and 10 has a second longitudinal actuator stroke C2 extending in the opposite direction to the first stroke C1 from the front towards the rear of the actuator 1, or downwards relative to the well, from the first trigger position to a second longitudinal trigger position that is set back relative to the first trigger position and that is shown in FIG. 4, in which the valve is caused to pass from the closed position to the open position.

Naturally, it is possible to provide only one of the first and second longitudinal trigger positions.

The invention is described below with reference to the first and second trigger positions both being present.

In each of the first and second trigger positions, the driven member 31 is held stationary in longitudinal position relative to the locking-and-trigger means 41, while the actuator member 21 is urged longitudinally relative to the locking-and-trigger means 41 by prestress means 51 provided between the driven member 31 and the actuator member 21 respectively in a forward direction or in a rearward direction so as to cause the actuator member 21 to pass respectively into the first or the second longitudinal position corresponding respectively to the valve 6 being in the closed position or the open position.

When only the first trigger position is provided, positioning the driven member 31 therein enables the prestress means 51 cause the actuator member 21 to move only into the first position, corresponding to the valve 6 passing from the open position to the closed position.

When only the second trigger position is provided, positioning the driven member 31 therein enables the prestress means 51 to cause the actuator member 21 to pass only into the second position, corresponding to the valve 6 passing from the closed position to the open position.

In the figures, the driven member 31 has a first pusher 37 for pushing the prestress means 51 longitudinally forwards during the first stroke C1 so as to reach the first trigger position, and a second pusher 38 for pushing the prestress means 51 longitudinally rearwards during the second stroke C2 in order to reach the second trigger position.

By way of example, the prestress means 51 is constituted by a helical compression spring inserted in the jacket 23 between the first and second pushers 37 and 38 around a central longitudinal rod 39 securely interconnecting the first and second pushers 37 and 38.

The first pusher 37 acts on the prestress means 51 via a first spacer 61 mounted to move longitudinally between the prestress means 51 and the first pusher 37, and constituted, for example, by a washer engaged via a hole of section smaller than the section of the first pusher 31 around the rod 39 in front of it.

The second pusher 38 acts on the prestress means 51 via a second spacer 62 mounted to move longitudinally between the prestress means 51 and the second pusher 38, and constituted, for example, by a washer engaged via a hole of section smaller than the section of the second pusher 32 around the rod 39 behind it.

A first abutment 63 for the jacket 23 is provided behind the first spacer 61, being of section greater than the first pusher 31 and greater than the rod 39 so as to allow them to slide longitudinally, while in front of the second spacer 62 there is provided a second abutment 64 for the jacket 23, which abutment is of section greater than that of the second pusher 38 and of the rod 39 so as to allow them to slide longitudinally. The first and second abutments 63 and 64 are spaced apart by the same distance L as the first and second pushers 37 and 38.

While the driven member 31 is moving forwards along the first stroke C1, the first pusher 31 causes the first spacer 61 to advance in front of the first abutment 63, as shown in FIG. 6, while the jacket 23 is held longitudinally by the locking-and-trigger means 41, thereby locking the second spacer 62 towards the front against the second abutment 64, and consequently reducing the distance between the first and second spacers 61 and 62 to a distance that is shorter than the distance L, thus compressing the spring 51. The jacket 23 includes an additional space 65 in front of the second pusher 38 in order to receive it during its first stroke C1 up to the first trigger position.

Conversely, during the displacement of the driven member 31 along the second stroke C2, the second pusher 38 urges the second spacer 62 rearwards behind the second abutment 64, as shown in FIG. 9, while the jacket 23 is held longitudinally by the locking-and-trigger means 41, thereby holding the first spacer 61 against the first abutment 63 and consequently reducing the thickness between the first and second spacers 61 and 62 to a distance smaller than the distance L, thus compressing the spring 51. An additional space 66 is provided in the jacket 23 behind the first abutment 63 for housing the first pusher 37 moving backwards inside the jacket 23 behind the first abutment 63 during the second stroke C2.

Connected in front of the portion 36, the driven member 31 has a sheath 67 for receiving the front end of the threaded shank 33 during the strokes C1 and C2 and in the first and second trigger positions. The sheath 67 is connected at its front end to a longitudinal guide part 47 of length L2 greater than or equal to the length of the first stroke C1 to the first trigger position and than the length of the second stroke C2 to the second trigger position.

The locking-and-trigger means 41 is located behind the rear additional space 66 and the first pusher 31. The locking-and-trigger means 41 has a support 42 secured inside the body 2 in front of the portion 36 and the nut 32 around the sheath 67 and the guide part 47. The support 42 comprises a longitudinal wall surrounding the guide part 47 and including one or more housings 44 respectively receiving one or more wedging parts 43 that are movable transversely to the longitudinal direction, e.g. radially. By way of example, the or each of the housings 44 is in the form of a through hole located in a prescribed longitudinal position of the longitudinal wall of the support 42. When a plurality of housings 44 and associated parts 43 are provided, the housings 44 are all in the same prescribed longitudinal position and separated by solid portions of the longitudinal wall of the support 42, i.e. the housings 44 are in transverse alignment so that each wedging part has a stroke that is limited in the associated housing 44 about the longitudinal direction 3. The guide part 47, the wedging part(s) 43, and a rear portion 68 of the jacket 23 surrounding the support 42 are configured in such a manner as to be face one another transversely during the first and second strokes C1 and C2 and in the first and second trigger positions.

For each wedging part 43, the outside surface of the guide part 47 has a first transverse housing recess 45, while the rear portion 24 of the jacket 23 includes, for each wedging part 43, a second transverse housing recess 46 for the wedging part 43. When a plurality of recesses 45 are provided, they are in transverse alignment. When a plurality of recesses 46 are provided, they are in transverse alignment. The first and second recesses 45, 46 are suitable for being brought transversely face to face when the first stroke C1 reaches the first trigger position, so as to cause the wedging part 43 to pass from the second recess 46 to the first recess 45.

When the wedging part 43 is in the first recess 45, it does not project into the second recess 46, thus enabling the jacket 23 to slide longitudinally relative to the support 42, which corresponds to the first trigger position as shown in FIG. 7.

In contrast, when the first and second recesses 45, 46 are longitudinally offset, the wedging part 43 is pressed against the guide part 47 away from the first recess 45 and penetrates into the second recess 46, as shown in FIGS. 5 and 6, thereby holding the rear portion 24 of the jacket 23 stationary in longitudinal position relative to the support 42, and enabling the guide part 47 to move longitudinally relative to the wedging part 43, with this state corresponding to the first stroke C1 to the first trigger position.

Likewise, in front of the first recess(es) 45, and for each wedging part 43, the guide part 47 has a third transverse recess 49 for housing the wedging part 43 in the second trigger position, and the rear portion 24 of the jacket 23 includes, behind the second recess(es) 46 and for each wedging part 43, a fourth transverse housing recess 50 for the wedging part 43. When a plurality of recesses 49 are provided, they are in transverse alignment. When a plurality of recesses 50 are provided, they are in transverse alignment. The third and fourth recesses 49, 50 are suitable for being brought transversely face to face when the second stroke C2 reaches the second trigger position, so as to cause the wedging part 43 to pass from the fourth recess 50 to the third recess 49. Around and between its recesses 46, 50, the jacket 23 has a closure wall 231 mounted thereon after the wedging parts 43 have been inserted in the support 44.

As shown in FIGS. 8 and 9, during the second stroke C2 to the second trigger position, the wedging part 43 is located in the fourth recess 50 of the rear portion 24 of the jacket 23 and outside the third recess 49 that is longitudinally offset relative to the recess 50, so as to secure the support 42 and the jacket 23 mutually in the longitudinal direction and enable the guide part 47 to be moved longitudinally relative to the wedging part 43.

In the second trigger position, the wedging part 43 drops into the third recess 49 and leaves the fourth recess 50 which are then facing each other transversely, so as to secure the guide part 47 transversely relative to the support 42 and allow the jacket 23 to move longitudinally rearwards under the rearwardly-directed force exerted by the prestress means 51 on the first spacer 61 and the first abutment 63.

By way of example, and as shown, the wedging part 43 is constituted by a ball, with the recesses 45 and 49 in the driven member 31 being of complementary shape, e.g. hemispherical. The recess 46 and/or 50 of the jacket 23 is constituted, for example, by a circular hole of diameter greater than the diameter of the ball in order to enable it to be inserted into the support 42 from the outside. By way of example, the housing 44 is also a circular hole diameter greater than that of the ball, located in the wall of the support 42. Naturally, the wedging part 43 could also be in the form of a roller having a cylindrical surface, the recesses 45 and 49 provided in the driven member 31 then also being in the form of hollow cylinders, e.g. in the form of circular half-cylinders, while the recesses 46, 50 are complementary oblong holes enabling the wedging part 43 to be inserted into the support 42 through the portion 24. By way of example, the housing 44 is in the form of a rectangular oblong through hole of dimensions corresponding to the generator lines and the bases of the roller in the wall of the support 42.

The valve 6 is caused to pass from the open position to the closed position by initially accumulating energy in the prestress means 51, e.g. by compressing a spring 51 in the jacket 23 during the first stroke C1 until the driven member 31 reaches the first trigger position.

The first trigger position enables the energy accumulated in the prestress means 51 during the first stroke C1 to be released so as to displace the actuator member 21 from the open position to the closed position. The force exerted on the actuator member 21 in the trigger position(s) depends on the capacity of the prestress mans 51 for storing energy, i.e. for a spring on its stiffness, on the magnitude of the prestress, and on the size of the stroke.

The sudden release of a fraction of the energy stored in the prestress means 51 when the first stroke C1 reaches the first trigger position causes a large force to be exerted on the piston 8 of the valve 6, thereby suddenly accelerating it in translation from the open position towards the closed position. Where appropriate, the prestress means 51 is designed so that any opposing forces between the piston 8 and the body 5 of the valve 6 are overcome, with the initial force exerted by the prestress means 51 in the trigger position being, for example, several times greater than said opposing force, for example being equal to or greater than three to ten times said opposing force.

In order to increase the initial force exerted by the prestress means 51 in the trigger position, the prestress means is organized, for example, so as to exert longitudinal repulsion between the actuator member 21 and the driven member 31 during the first stroke C1 prior to reaching the first trigger position. For example, the prestress means 51 can be implemented in the form of a helical spring that is already longitudinally compressed between the spacers 61 and 62 when they are spaced apart at their greatest distance. The prestress means 51 may also be provided in the form of a spring having undulating turns. After triggering opening or closing, the spring 51 continues to exert a force on the actuator member 21 to hold the valve 6 in the respectively open or closed position that it has just taken up.

Naturally, the above applies in corresponding manner to the second stroke C2 and the second trigger position.

This causes the actuator member 21 and the piston 8 to move very quickly in translation so as to pass from the open position occupied during the first stroke C1 until immediately before the first trigger position to the closed position that is occupied on reaching the first trigger position. The time required to close the valve that elapses between the last instant when the piston 8 is stationary relative to the body 5 of the valve 6 in the open position, and the first instant when it is in the closed position is very short, and of a duration of less than one second, whereas in prior art valves performing a valve closure movement, the time is more than 50 seconds.

Naturally, the same applies for the second stroke C2 and the second trigger position, likewise causing fast opening movement in which the actuator member 21 and the piston 8 pass from the closed position to the open position in a length of time that is likewise short between the first instant when the piston 8 is stationary relative to the body 5 of the valve 6 in the closed position and the first instant when it is in the open position.

Figure 11:
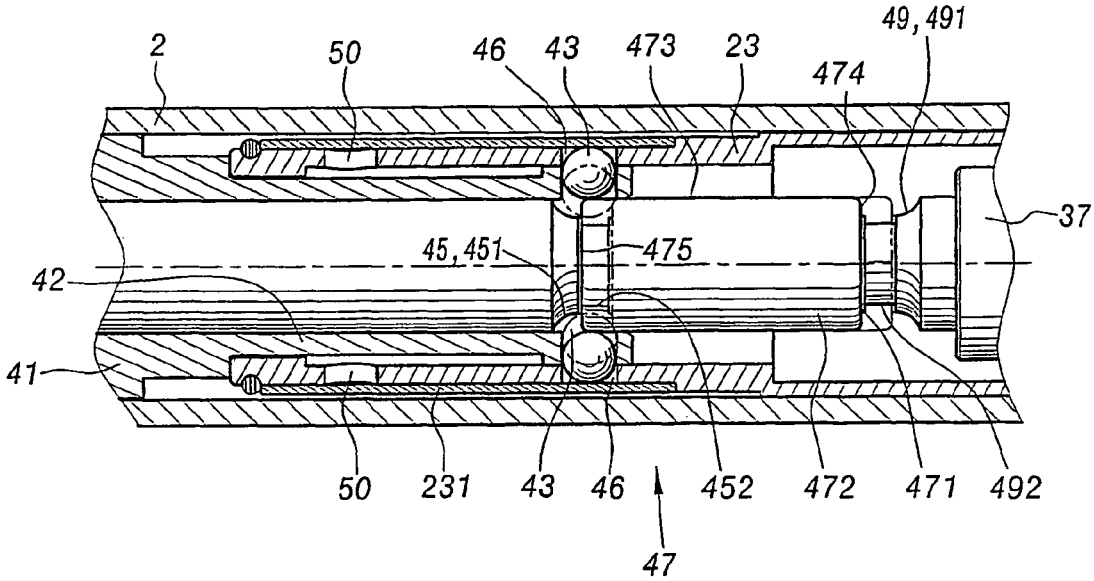
FIG. 11 is a diagram on a larger scale showing a variant embodiment of a guide part constituting a portion of the means for locking and triggering the actuator shown in FIGS. 4 to 10.

In FIG. 11, the guide part 47 comprises a central support rod 471 which is secured to the sheath 67 and the pusher 37 and which has the first and/or third recesses 45, 49 at its ends, with the longitudinal halves 451, 491 thereof that are furthest apart being analogous to those shown in FIGS. 4 to 9, while the closer-together longitudinal halves 452, 492 thereof are formed by respective grooves of rectilinear profile and at right angles connected to the central rod 471.

A guide sleeve 472 is mounted to move longitudinally around the central support rod 471. The guide sleeve 472 has an outer guide surface 473 for guiding the wedging part(s) 43 in a manner analogous to the guide part 47 of FIGS. 4 to 9. The outer guide surface 473 is connected to the front and rear transverse edges 474 and 475 that are separated from each other by a distance substantially equal to the distance between the middle of the first recess 45 and the far end of the third recess 49.

As shown in continuous lines in FIG. 11, the wedging part(s) 43 is/are located against the outer guide surface 473 during the strokes C1 and C2. At the end of the first stroke C1, the wedging part(s) 43 come(s) against the rear transverse edge 475. Then, in the first trigger position shown in dashed lines in FIG. 11, the wedging part(s) 43 passing from the recess 46 into the first recess 45 simultaneously push the rear transverse edge 475 forwards until the guide sleeve 472 comes into abutment against the front half 491 of the recess 49. The process is analogous for the second stroke C2 and the second trigger position.

Figure 12:
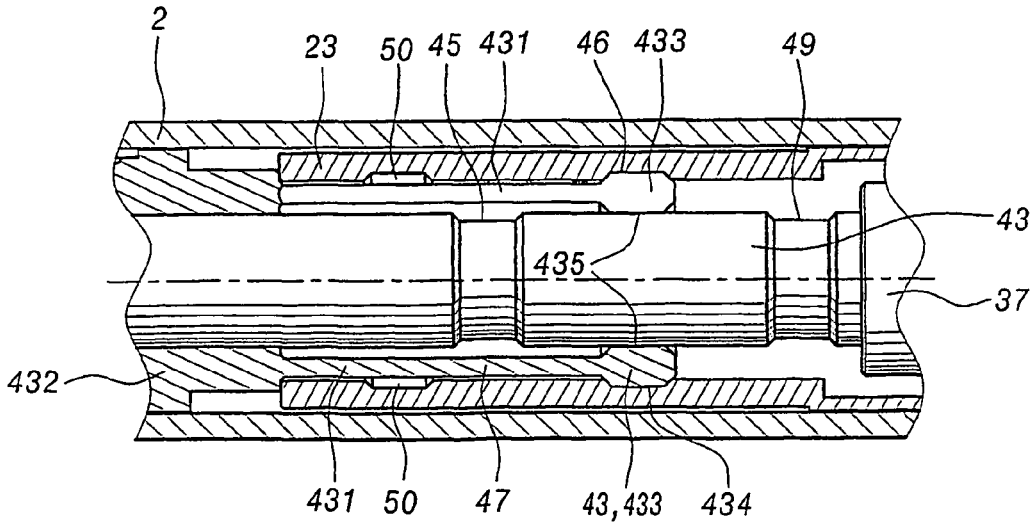
FIG. 12 is a diagram on a larger scale showing a variant embodiment of a wedging part constituting a portion of the means for locking and triggering the actuator shown in FIGS. 4 to 10.

In FIG. 12, one or more wedging parts 43 and a support 42 constituting a single part are provided between the driven member 31 and the jacket 23, said part comprising a plurality of tabs 431 that are spaced apart from one another and connected at their rear ends to a part 432 that is stationary relative to the body 2. The housings 44 are omitted. At the front, each tab 431 is provided with a jaw 433 forming a wedging part 43, having an outer portion 434 facing the jacket 23 and of longitudinal section that is complementary in shape to the second and fourth recesses 46, 50, and an inner portion 435 facing towards the guide part 43 and of longitudinal section complementary in shape to the first and third recesses 45, 49.

By way of example, the recesses 45, 46, 49, and 50 are in the form of grooves of rectilinear profile formed respectively in the guide part 47 and in the jacket 23, the wall 231 being integral with the jacket 23. Complementary ramps are provided on the portions 434, 435 and in the recesses 45, 46, 49, and 50 to enable the jacket 23 or the driven member 31 to be locked longitudinally relative to the tabs 431.

The tabs 431 are made of a material presenting a degree of flexibility that enables them to bend transversely so as to be capable of passing from one recess 50, 46 to the other 45, 49 in the first and second trigger positions, and so as to be found in the recess 46 or 50 against the guide part 47 and between its recesses 45 and 49 during the strokes C1 and C2.

The actuator member 21 is caused to pass into the first or the second trigger position by controlling the drive device 35 so as to move the nut 32 into corresponding longitudinal positions on the threaded shank 33. This control is performed, for example, by controlling means for powering the drive device 35 that are not shown and that are associated with the actuator and/or with the tool down-hole. For example, the power supply means may be provided in the form of an optionally rechargeable battery which is controlled so as to be connected to the drive device 35 in order to cause it to turn its shaft 34 in one direction or the other during the stroke C1 or C2. The power supply means may be designed so as to be capable of performing a plurality of strokes C1 and C2 without it being necessary for them to be recharged or changed, thereby enabling the actuator to be used for longer periods of time. At its rear end, the actuator body 2 has a sealed feedthrough 81 enabling the drive device 35 to be electrically connected to power supply and control means that are provided in a unit secured to the actuator body 2 or integrally extending it. By way of example, the drive device 35 includes means for counting revolutions of its shaft 34 and includes a brushless driving motor, for example. The electrical power supply of the actuator may also be provided by means of a cable connected at the surface to a source of electricity. The actuator may also be controlled by being preprogrammed on the surface prior to being lowered down a well. Connecting the power supply means to the actuator then causes a program that has been prerecorded in the actuator to be run.

Sealing means 71 that are proof against the production fluid are provided around the rod 22 in front of a front shoulder 23*c* of the fastening portion 23*b* of the jacket 23 and behind the front end of the body 2. These sealing means 71 are provided, for example, in the form of a piston surrounding the rod 22 in the body 2 and carrying a first sealing gasket 72 on its outer peripheral face facing towards the inside of the body 2, and a second sealing gasket 73 on its inner face facing towards the rod 22. The piston 71 is advantageously mounted to slide relative to the rod 22 and the body 2 in order to balance the pressure differences that exist longitudinally on opposite sides thereof. The gaskets 72 and 73 are thus better preserved from the pressure differences on either side thereof longitudinally.

The space inside the body 2 situated behind the sealing means 71 is filled with an operating fluid, e.g. a fluid that is largely incompressible under the operating conditions in the well. By way of example, this operating fluid may be constituted by an oil.

Figure 13:
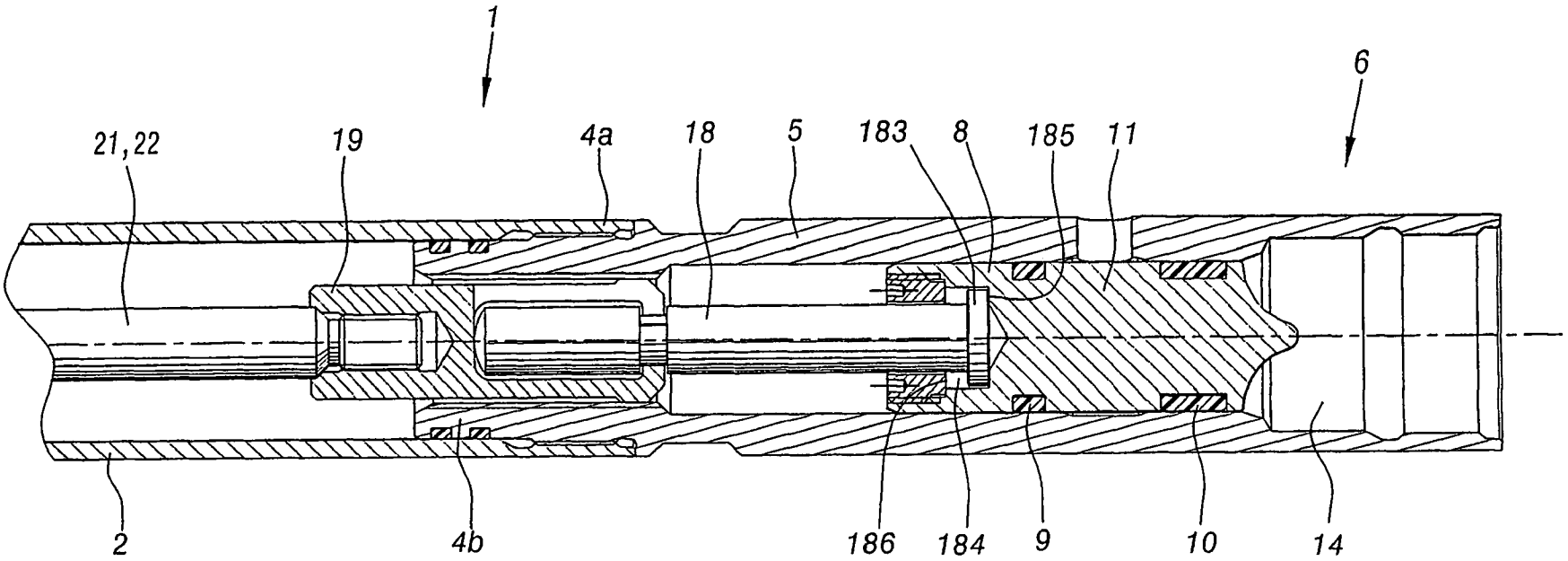
FIG. 13 is a diagram on a larger scale of a variant embodiment of the connection between a member for fastening to the actuator member and the piston of the valve shown in FIGS. 4 to 12.

In FIG. 13, the piston 8 of the valve 6 is connected with longitudinal clearance to the fastener member 18 of FIGS. 4 to 10 or of FIGS. 3A to 3C. The fastener member 18 has a transverse shoulder 183 at its front end that is inserted to slide longitudinally in a rear housing 184 of the piston 8, defined by front and rear abutments 185 and 186 therein which define determined longitudinal clearance between them for the shoulder 183 that is shorter than the length that exists between the open and closed positions thereof.

While the valve 6 is kept open, the shoulder 183 is held by the members 18, 19, and 21 against the rear abutment 186, and while the valve 6 is being kept closed, as shown in FIG. 13, the shoulder 183 is held by the members 18, 19, and 21 against the front abutment 185. Thereafter, when the valve 6 passes from the open position or the closed position to the closed position or the open position, the clearance provided for the shoulder 183 enables it to arrive at high speed in the appropriate direction against the opposite abutment 185 or 186, thereby exerting a jolt on the piston 8, helping separate its gaskets 9, 10 from the body 5.

In FIGS. 14A to 14D, the piston 8 of the valve 6 has a single front outer gasket 10, and a rear central internal chamber 111 capable of communicating firstly via a transverse duct 112 with the outside of its support wall 11, and secondly via a longitudinal duct 113 with the front space 14. When the piston 8 is in its closed position relative to the hole 7, the transverse duct 112 opens out into the hole 7. The ducts 112 and 113 present the fluid produced in the well with a flow section that is smaller than that of the hole 7. The chamber 111 is also defined rearwards by a secondary piston 114 mounted to slide longitudinally and secured to the member 18 in front of the shoulder 183.

Figure 14A:
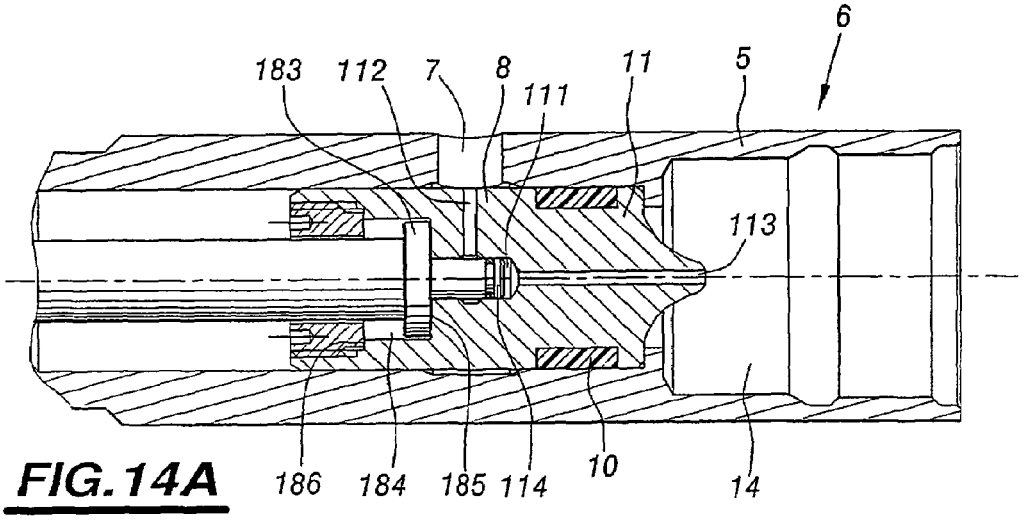
FIGS. 14A, 14B, and 14C are diagrams on a larger scale showing a variant embodiment of the piston of the valve shown in FIGS. 3A, 3B, 3C, 4 to 10, and 13.
Figure 14B:
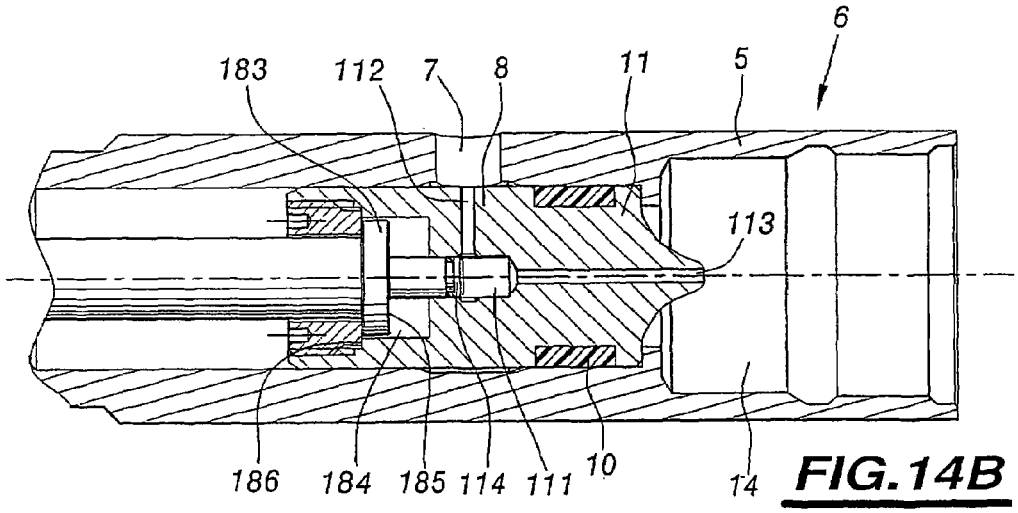
Figure 14C:
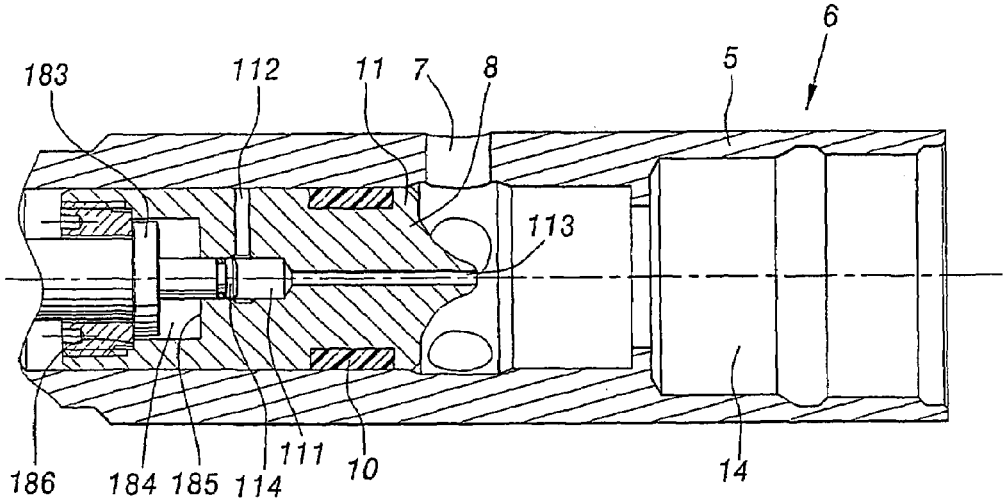

When, as shown in FIG. 14A, the shoulder 183 is advanced against the abutment 185, the secondary piston 114 closes off communication between the ducts 112 and 113 via the chamber 111 by any suitable sealing means, whereas, as shown in FIGS. 14B and 14C, when the shoulder 183 is moved rearwards against the abutment 184, the secondary piston 114 allows the ducts 112 and 113 to communicate via the chamber 111, while preventing the fluid from passing into the housing 184 and the actuator. In this manner, the movement of the piston 8 opening the hole 7 as shown in FIG. 14C is preceded by communication being established via its ducts 112 and 113 as shown in FIG. 14B, thus allowing a small flow of production fluid to pass from the well into the front face 14, and reducing the risks of the wall of the production well collapsing because of fluid being sucked into the opening of the valve, since that would block the well. This embodiment is particularly advantageous for poorly consolidated wells.

Figure 15:
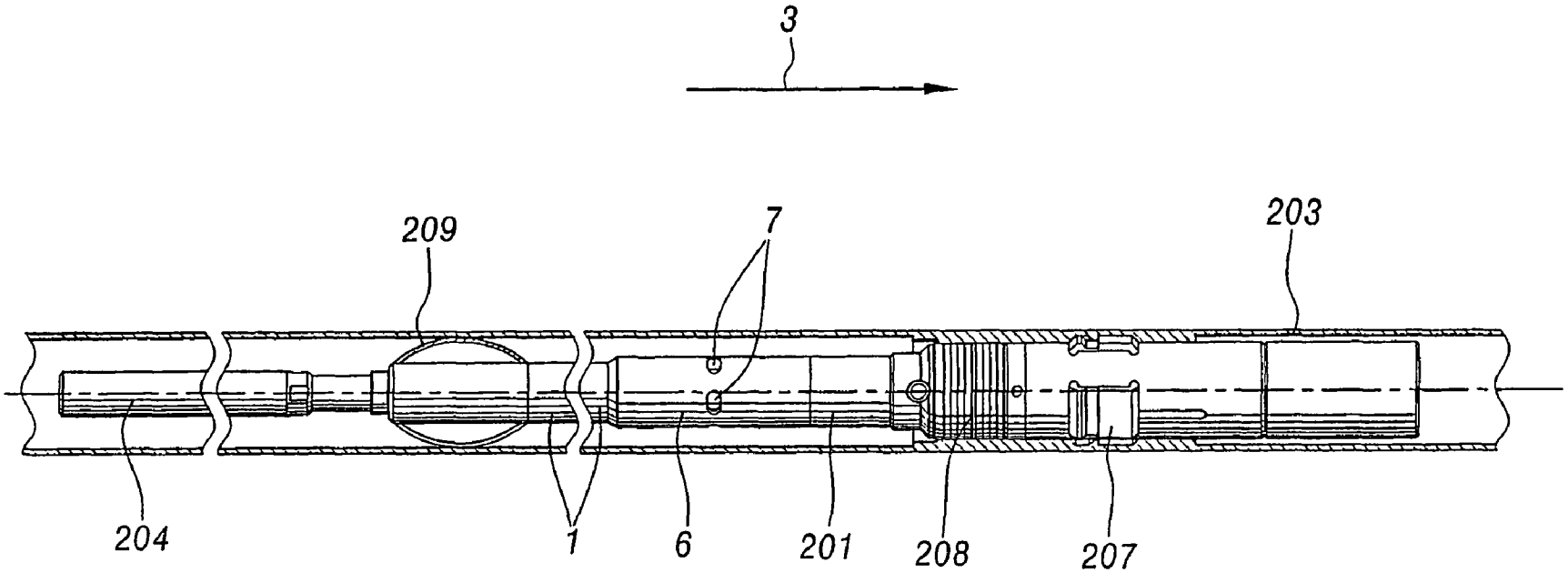
FIG. 15 is a diagram of a scale smaller than that of FIGS. 4 to 9 showing the actuator in accordance with the invention mounted on a valve.

In FIG. 15, the actuator 1 in accordance with the invention can be integrated with a tool 201. Such a tool 201 may comprise, in addition to the actuator 1 and the valve 6, a unit 204 having sensors for the pressure, temperature, flow rate, and/or other parameters beneath the actuator 1, and means for recording the measurement information produced by the sensors. The tool 201 comprises, mechanically connected together from top to bottom, a member 207 for blocking the tool in position by anchoring it against the duct 203, including sealing gaskets 207 proof against the production fluid and acting against the duct 203, the valve 6, the actuator 1, an optional centralizer 209 having bows acting against the duct 203, and the unit 204.

The invention claimed is:

1. A quick-acting valve actuator comprising:

an actuator body; and a valve actuator member movable in the actuator body between a valve closed position and a valve open position;

the actuator further comprising:

a drive device in the actuator body;

a driven member driven by the drive device relative to the actuator body, the drive device being suitable for causing the driven member to pass via a first stroke to a first trigger position;

prestress means for prestressing the actuator member relative to the driven member in order to exert a repulsion force thereagainst when the driven member passes along its first stroke to its first trigger position, said force tending to cause the actuator member at least to pass from a first determined position selected from the valve-open and valve-closed positions to the second determined position selected from the valve-open and valve-closed positions; and locking-and-trigger means stationary relative to the actuator body and co-operating with the driven member and the actuator member so that:

during the first stroke, the actuator member is stationary in the first determined position relative to the locking-and-trigger means and the driven member moves relative to the locking-and-trigger means; and when the driven member reaches the first trigger position, the driven member is stationary relative to the locking-and-trigger means and the actuator member is urged by the prestress means relative to the locking-and-trigger means so that the actuator member passes from the first determined position to the second determined position.

2. A quick-acting valve actuator according to claim 1, wherein the drive device is suitable for causing the driven member to pass along a second stroke to a second trigger position, the prestress means being suitable, when the driven member passes along the second stroke to its second trigger position, for exerting a repulsion force thereagainst tending to cause the actuator member to pass from the second determined position to the first determined position, and the locking-and-trigger means is configured to co-operate with the driven member and the actuator member so that:

during the second stroke, the actuator member is stationary in the second determined position relative to the locking-and-trigger means, and the driven member moves relative to the locking-and-trigger means; and when the driven member is in the second trigger position, the driven member is stationary relative to the locking-and-trigger means, and the actuator member is urged by the prestress means relative to the locking-and-trigger means so that the actuator member passes from the second determined position to the first determined position.

3. A quick-acting valve actuator according to claim 1, wherein the stroke is longitudinal, the actuator member being movable longitudinally between the valve-closed position and the valve-open position, the driven member being longitudinally movable relative to the actuator body over the stroke.

4. A quick-acting valve actuator according to claim 3, wherein the locking-and-trigger means comprise:

at least one wedging part movable transversely relative to the actuator body; and first and second recesses for housing the wedging part respectively in the driven member and in the actuator member, the first and second recesses being offset at least longitudinally during the first stroke up to the first trigger position, so that the wedging part lies outside the first recess of the driven member and in the second recess of the actuator member so as to secure the actuator member longitudinally relative to the support and allow the driven member to move longitudinally relative to the support, and the first and second recesses come transversely face to face in the first trigger position so that the wedging part can pass out from the second recess of the actuator member into the first recess of the driven member so as to secure the driven member longitudinally relative to the support and allow the actuator member to move longitudinally relative to the support.

5. A quick-acting valve actuator according to claim 4, wherein the drive device is suitable for causing the driven member to pass along a second stroke to a second trigger position, the prestress means being suitable, when the driven member passes along the second stroke to its second trigger position, for exerting a repulsion force thereagainst tending to cause the actuator member to pass from the second determined position to the first determined position, and the locking-and-trigger means is configured to co-operate with the driven member and the actuator member so that:

during the second stroke, the actuator member is stationary in the second determined position relative to the locking-and-trigger means, and the driven member moves relative to the locking-and-trigger means; and when the driven member is in the second trigger position, the driven member is stationary relative to the locking-and-trigger means, and the actuator member is urged by the prestress means relative to the locking-and-trigger means so that the actuator member passes from the second determined position to the first determined position, and wherein the locking-and-trigger means include third and fourth recesses for housing the wedging part respectively in the driven member and in the actuator member, the third recess being longitudinally spaced apart from the first recess, the third and fourth recesses being offset at least longitudinally during the second stroke up to the second trigger position so that the wedging part lies outside the third recess of the driven member and in the fourth recess of the actuator member so as to cause the actuator member to be secured longitudinally relative to the support and allow the driven member to move longitudinally relative to the support, the third and fourth recesses coming transversely face to face in the second trigger position so that the wedging part can pass out from the fourth recess of the actuator member into the third recess of the driven member so as to cause the driven member to be secured longitudinally relative to the support and allow the actuator member to move longitudinally relative to the support.

6. A quick-acting valve actuator according to claim 4, wherein the wedging part is mounted to move freely transversely in a support that is stationary relative to the actuator body and that is provided transversely between the driven member and the actuator member.

7. A quick-acting valve actuator according to claim 6, wherein the wedging part is constituted by a ball.

8. A quick-acting valve actuator according to claim 6, wherein the wedging part is constituted by a roller.

9. A quick-acting valve actuator according to claim 4, wherein the driven member includes a stationary guide part for guiding the wedging part during said stroke.

10. A quick-acting valve actuator according to claim 4, wherein the wedging part is formed by a jaw of a transversely flexible tab and connected, at a longitudinal distance from the jaw to a part that is stationary relative to the body.

11. A quick-acting valve actuator according to claim 4, wherein the driven member includes a stationary support part having a guide sleeve mounted to move longitudinally thereon to guide the wedging part during said stroke, the guide sleeve being suitable for being urged longitudinally by the wedging part when the wedging part penetrates into the recess of the driven member.

12. A quick-acting valve actuator according to claim 4, wherein at least one of the recesses provided in the actuator member is outwardly open to enable the wedging part to be inserted into the support.

13. A quick-acting valve actuator according to claim 3, wherein the actuator member comprises a rod secured to a jacket, the driven member comprises a rod that is longitudinally movable inside the jacket and that has at least a first pusher for pushing the prestress means longitudinally while the driven member is traveling along its stroke to the trigger position, a second pusher being provided between the prestress means and the jacket.

14. A quick-acting valve actuator according to claim 13, wherein the jacket has first and second abutments for first and second spacers movably mounted between the prestress means and the first and second pushers respectively, the jacket including first and second additional penetration spaces respectively for the first and second pushers while the driven valve is moving along its stroke to the associated longitudinal trigger position.

15. A quick-acting valve actuator according to claim 14, wherein the prestress means is formed by a compression spring between the actuator member and the driven member, and wherein the compression spring is helical and wound around the rod of the driven member.

16. A quick-acting valve actuator according to claim 14, wherein the first position corresponds to the valve-closed position and the second position corresponds to the valve-open position, and wherein the compression spring has turns undulating around the rod of the driven member.

17. A quick-acting valve actuator according to claim 3, wherein the driven member comprises a nut prevented from turning inside the actuator body and co-operating with a threaded shank driven in rotation by the drive device to move the driven member longitudinally.

18. A quick-acting valve actuator according to claim 1, wherein the first position corresponds to the valve-open position and the second position corresponds to the valve-closed position.

19. A quick-acting valve actuator according to claim 1, wherein the first position corresponds to the valve-closed position and the second position corresponds to the valve-open position.

20. A quick-acting valve actuator according to claim 1, wherein the prestress means is such as to increase the repulsion force between the actuator member and the driven member while the driven member is passing along its stroke to its trigger position, and such that it exerts a force for preventing the actuator member from moving when in its second determined position.

21. A quick-acting valve actuator according to claim 1, wherein the prestress means is formed by a compression spring between the actuator member and the driven member.

22. A quick-acting valve actuator according to claim 1, including sealing means between the actuator body and the actuator member for sealing the drive device, the driven member, the prestress means, and the locking-and-trigger means relative to the outside.

23. A quick-acting valve actuator according to claim 22, wherein the sealing means comprise a piston mounted to slide longitudinally along the actuator member, the piston of the sealing means including sealing gaskets applied respectively against the inside of the actuator housing and against the actuator member.

24. A quick-acting valve actuator according to claim 22, wherein the space inside the actuator body situated behind the sealing means and containing the drive device, the driven member, the prestress means, and the locking-and-trigger means, is filled with an operating fluid.

25. A quick-acting valve actuator according to claim 24, wherein the operating fluid is constituted by a lubricating oil.

26. A quick-acting valve actuator according to claim 1, wherein the actuator body further contains a sealed feedthrough for electrically connecting the drive device to power supply and control means therefor on board the actuator.

27. A quick-acting valve actuator according to claim 1, wherein the drive device is a motor-and-gearbox unit.

28. A quick-acting valve actuator according to claim 1, wherein the drive device includes a brushless motor.

29. A quick-acting valve actuator according to claim 1, wherein the drive device includes a roller screw for driving a nut of the driven member.

30. A tool comprising a valve having a closed position and an open positi1on, and a valve actuator according to claim 1.

31. A tool according to claim 30, further comprising at least one measurement sensor and means for recording measurement information from the sensor, the actuator being located longitudinally between the valve and said sensor.

32. A tool according to claim 30, wherein the valve comprises a piston which is mounted to move between a position for closing and a position for opening at least one hole in a valve body opening to the outside relative to a fluid-passing space, and connected to a fastener member for fastening to a corresponding member of the actuator member.

33. A tool according to claim 32, wherein the fastener member is formed by a thread co-operating with a complementary thread forming the corresponding member of the actuator member.

34. A tool according to claim 32, wherein the corresponding member of the actuator member is formed by a clamp comprising a plurality of resilient branches suitable for occupying a splayed open position enabling a hooking part forming a fastener member to be inserted therebetween while they lie outside a guide wall provided in the valve, and which are suitable for clamping on the hooking part while they are to be found against the guide wall between the closed position and the open position.

35. A tool according to claim 32, wherein the piston of the valve is connected to the fastener member with determined longitudinal clearance that is shorter than the distance that exists between the open position and the closed position thereof.

36. A tool according to claim 32, wherein the valve further comprises a secondary piston which is slidably mounted in a chamber of the piston having secondary fluid communication means between the hole and the fluid-passing space, which is connected to the actuator member, which closes the chamber of the piston in the closed position, and which is suitable during passage of the actuator member from the closed position to the open position for causing the hole to communicate with the fluid-passing space via the secondary communication means.

* * * * *